United States Patent [19]

Lyall

[11] 3,939,560

[45] Feb. 24, 1976

[54] SHAVING EQUIPMENT

[75] Inventor: Robert Lyall, Slough, England

[73] Assignee: Wilkinson Sword Ltd., England

[22] Filed: Jan. 30, 1974

[21] Appl. No.: 437,933

[30] Foreign Application Priority Data

Jan. 31, 1973 United Kingdom ..... 4870/73

[52] U.S. Cl. ..... 30/34.2; 30/81

[51] Int. Cl.[2] ..... B26B 19/42

[58] Field of Search ..... 30/32, 34.2, 81, 83; 128/62 R

[56] References Cited

UNITED STATES PATENTS 2,048,565 7/1963 Rodrigues ..... 30/83

3,388,831 6/1968 Hansom ..... 30/32 UX

*Primary Examiner*—Al Lawrence Smith

*Assistant Examiner*—Gary L. Smith

*Attorney, Agent, or Firm*—Wolfe, Hubbard, Leydig, Voit & Osann Ltd.

[57] ABSTRACT

The invention provides shaving equipment having a guard surface which bears against the skin of the user during shaving, wherein a part at least of said surface is roughened.

14 Claims, 2 Drawing Figures

SHAVING EQUIPMENT

This invention relates to shaving equipment. It is applicable to razors of the kind which utilise a replaceable blade and also those which utilise shaving units. By the term 'shaving unit' is meant a substantially rigid member, generally of plastics material, to which is secured one or more razor blades each having one or more cutting edges, the rigid member providing a guard surface located at a pre-set spacing from the cutting edge or cutting edges of the, or each, blade.

According to the present invention there is provided shaving equipment having a good surface which bears against the skin of the user, during shaving, wherein a part at least of said surface is roughened.

Figure 1:
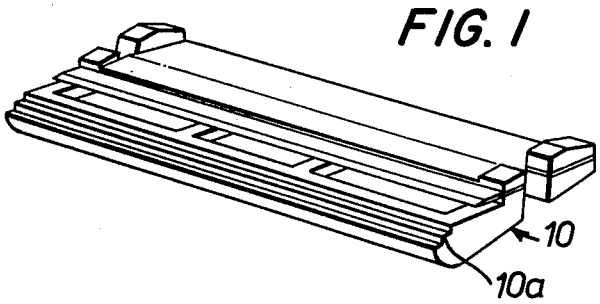
Figure 20:
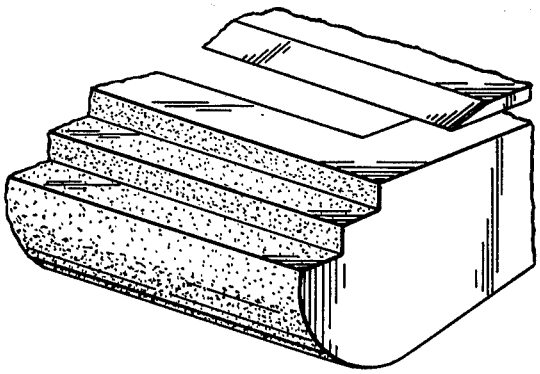

The novel features of the present invention will be better understood from a consideration of the following description of one form of shaving equipment in accordance with the invention which will be described, by way of example, with reference to the accompanying drawings which FIG. 1 is a perspective view of a shaving unit embodying the present invention and FIG. 2 is a highly exaggerated and magnified schematic representation of a portion of the guard surface of FIG. 1.

The application of the invention to shaving units having a guard surface 10*a* with a stepped profile as shown in the drawing will first be considered. In accordance with the invention at least a part of the guard surface 10*a* of the shaving unit 10 is roughened by any suitable method. The surface roughness may, for example, be between 0.5 micrometers and 10.0 micrometers centre-line-average values. 'Centre line average values' is defined in British Standard No. 1134 of 1961 and corresponds to the term 'arithmetical average' used in American Standard ASA B.46. Preferably, the surface roughness lies within the range of 2.5 to 5.0 micrometers, with the roughness varying across the surface but lying within the preferred range. Preferably, the average distance between the more prominent irregularities on the profile of a section through the surface (referred to as the 'spacing' in British Standard 1134 of 1961, and hereinafter, as the 'spacing') is in the range of 0.5 to 5.0 times the surface roughness.

Examples of methods which may be used to achieve this degree of roughness are by abrading with particles of grit, ceramics, oxides or metals, by mechanical roughening, or by roughening the surface of a mould in which the guard surface is formed so that the moulded guard surface has the desired degree of roughness.

Thus, a plastic guard surface has been roughened by grit blasting, for approximately 5 seconds, using No. 46 grit of silicon carbide ejected from a nozzle having a diameter of 0.110 of an inch under an air pressure of 60 pounds per square inch, the nozzle being located at a distance of from 2 to 6 inches from the guard surface.

Alternatively, the surface of the guard bar may be coated or impregnated with particles, for example particles of grit, ceramics, oxides or metals, to give the desired degree of surface roughness.

The particles can be incorporated in the plastic powder prior to moulding so that the particles would project from the surface after moulding due to shrinkage of the plastic. A typical particle size would be within the range of from 10 to 50 microns.

Another method of providing a rough surface is to prepare a thin film of material which is rough on one side and bears adhesive on the other side by which a length of the film can be caused to adhere to the guard surface. The roughness of the one side of the film may be a result of the presence of grit or other appropriate particles.

The invention can likewise be applied to razor frames of the kind utilising replaceable razor blades which are not secured in a rigid body, by appropriate treatment of part at least of the guard surface of the razor frame. Similar methods may be used for roughening the surface to those described above.

Tests by panels of men have demonstrated that razor frames and shaving units treated in accordance with the invention are preferred to those which have not been treated in this way.

I claim:

1. Shaving equipment having a longitudinally extending razor blade and a guard surface which bears against the skin of the user during shaving, wherein a part at least of said surface has a roughness of between 0.5 and 10.0 micrometers centre-line-average values.

2. Shaving equipment according to claim 1, wherein the roughness is between 2.5 and 5.0 micrometers centre-line-average values.

3. Shaving equipment according to claim 1, wherein the spacing is from 0.5 to 5.0 times the surface roughness.

4. Shaving equipment according to claim 1, having particles of material incorporated in the surface to provide the roughness.

5. Shaving equipment according to claim 4, wherein the size of the particles is within the range of from 10 to 50 microns.

6. Shaving equipment according to claim 1, wherein a film of material which is rough on its outer surface is caused to adhere to the guard surface to provide said roughened surface.

7. Shaving equipment according to claim 1, wherein the roughness is measured in a direction substantially at right angles to the blade cutting edge.

8. Shaving equipment having a longitudinally extending razor blade and a guard surface with a stepped profile which bears against the skin of the user during shaving, wherein a part at least of said surface has a roughness of between 0.5 and 10.0 micrometers centre-line-average values.

9. Shaving equipment according to claim 8, wherein the roughness is between 2.5 and 5.0 micrometers centre-line-average values.

10. Shaving equipment according to claim 8, wherein the spacing is from 0.5 to 5.0 times the surface roughness.

11. Shaving equipment according to claim 8, having particles of material incorporated in the surface to provide the roughness.

12. Shaving equipment according to claim 11, wherein the size of the particles is within the range of from 10 to 50 microns.

13. Shaving equipment according to claim 8, wherein a film of material which is rough on its outer surface is caused to adhere to the guard surface to provide said roughened surface.

14. Shaving equipment according to claim 8, wherein the roughness is measured in a direction substantially at right angles to the blade cutting edge.

* * * * *